US008261400B2

(12) United States Patent
Reim

(10) Patent No.: US 8,261,400 B2
(45) Date of Patent: Sep. 11, 2012

(54) BRUSH SYSTEM FOR A LABELING MACHINE

(75) Inventor: Hans-Juergen Reim, Neutraubling (DE)

(73) Assignee: Krones AG, Neutraubling (DE)

( * ) Notice: Subject to any disclaimer, the term of this patent is extended or adjusted under 35 U.S.C. 154(b) by 534 days.

(21) Appl. No.: 12/534,414

(22) Filed: Aug. 3, 2009

(65) Prior Publication Data

US 2010/0032102 A1 Feb. 11, 2010

(30) Foreign Application Priority Data

Aug. 6, 2008 (DE) ..... 10 2008 036 676

(51) Int. Cl.
*A46B 7/06* (2006.01)

(52) U.S. Cl. ..... 15/202; 15/21.1

(58) Field of Classification Search ..... 15/22.1, 15/22.2, 202
See application file for complete search history.

(56) References Cited

U.S. PATENT DOCUMENTS

| | | | | |
|---|---|---|---|---|
| 1,445,321 | A | 2/1923 | Johnson et al. | |
| 2,661,109 | A | 12/1953 | Gerhardt | |
| 4,227,276 | A | 10/1980 | Ginsberg et al. | |
| 5,170,525 | A * | 12/1992 | Cafaro | 15/28 |
| 7,636,976 | B2 * | 12/2009 | Banning | 15/22.1 |
| 2003/0135946 | A1 | 7/2003 | MacLean | |
| 2004/0177462 | A1 * | 9/2004 | Brown et al. | 15/167.1 |

FOREIGN PATENT DOCUMENTS

| | | |
|---|---|---|
| DE | 6931835 | 12/1969 |
| DE | 1940933 | 3/1971 |
| DE | 2518360 | 11/1976 |
| DE | 2522261 | 12/1976 |
| DE | 3511910 | 2/1986 |
| DE | 68907262 | 11/1993 |
| DE | 4234439 | 4/1994 |
| DE | 29817657 | 12/1998 |
| DE | 19726970 | 1/1999 |
| DE | 10052119 | 5/2002 |
| EP | 0339933 | 11/1989 |
| EP | 0592893 | 10/1993 |

* cited by examiner

*Primary Examiner* — Shay Karls
(74) *Attorney, Agent, or Firm* — Simpson & Simpson, PLLC

(57) ABSTRACT

A brush system (1) for a labeling machine (40) is disclosed. The brush system (1) comprises a carrier (30) with a plurality of receptacles (32) and at least two brush elements (10) removably attached to the carrier (30). Each brush element (10) comprises a brush body (11) with a functional side (13) on a first side of the brush body (11), the functional side (13) having bristles (14), and with a carrier side (12) on a second side of the brush body (11). The carrier side (12) of each brush element (10) exhibits at least one clamping means (15), which together with a receptacle (32) of the carrier (30) provides for a removable attachment. Each clamping means (15) exhibits at least two elastic catch hooks (16), which lock into one of the receptacles (32).

6 Claims, 4 Drawing Sheets

BRUSH SYSTEM FOR A LABELING MACHINE

CROSS REFERENCE TO RELATED APPLICATIONS

This patent application claims priority of German Patent Application No. 10 2008 036 676.5, filed on Aug. 6, 2008, the application is incorporated herein by reference in its entirety.

FIELD OF THE INVENTION

The present invention relates to a brush system for a labeling machine.

BACKGROUND OF THE INVENTION

German Patent Application DE 35 11 910 A1 discloses a method for the creation of brush arrays of constant density out of bristled elements as well as a brush array created by this method. The brush arrays are formed on a carrier out of the elements. The elements are attached to the carrier with notches and pins and interlock with each other.

German Patent Application DE 42 34 439 discloses a technical brush with a flexible brush carrier. The elements are attached to an endless belt carrier by notches and pins.

German Utility Model DE 298 17 657 discloses a technical, elongated strip brush with a flexible, endless brush body, which has a bristled section of compact cross section. The brush body consists of a flexible material. The strip brush comprises clamping means for easy and quick mounting or the attachment of the strip brush to another object without requiring tools. Accordingly a notch is provided, which comprises barbs on the inside. The other object is inserted into the notch. The barbs hold the other object in the notch.

German Patent Application DE 197 26 970 discloses a brush body for a rotary brush with a plurality of brush body elements, which can be mounted to or dismounted from a supporting shaft quickly and easily. The brush body is a cylindrical shell formed by two semi-shells with abutting axial edges. Recesses in the semi-shells, connecting elements, which either already are attached to a neighboring shell element or can firmly be attached to it, as well as projections in the recesses serve the purpose of mounting and dismounting the brush body elements. The connecting elements can engage behind the projections. In this way a non-permanent, form-fitting connection along the circumference of the brush body is created between the two semi-shells.

German Patent Application DE 100 52 119 discloses a sector ring brush for keeping clear or cleaning cylindrical bodies, in particular quartz cladding tubes in UV disinfection facilities, especially UV disinfection channels for the disinfection of wastewater. The sector ring brush consists of sector elements, whose trimming can be applied before it is mounted into a casing, wherein the sector elements are to be mounted into a ring shaped casing one by one or connected, for example with connecting bars along the circumference.

German Translation DE 689 07 262 T2 of European Patent EP 0 339 933 B1 discloses a brush section for a rotary finishing brush and a facility and method for the manufacture of the same. Therein a cylindrical brush apparatus with a first substrate is exhibited, the substrate being attached to hubs, and a layer of bristles, which are fixed to the first substrate and which extend outwards from the first surface of the first substrate. A second substrate and a layer of bristles are also exhibited, the bristles being fixed to the second substrate and extending outwards from the first surface of the second substrate. The brush elements are removably attached to a hub by root elements in the respectively first or second substrate of the brush body.

SUMMARY OF THE INVENTION

An object of the invention is to create a brush system with at least two brush elements, the brush elements of which can be exchanged safely, easily, quickly, and cost-effectively, wherein the composition of the brush system is flexible with respect to its form, size and kind with a minimum number of different types of brush elements.

The above object is achieved by a brush system comprising

- at least two brush elements, wherein each brush element comprises a brush body with a functional side having bristles on a first side of the brush body and with a carrier side on a second side of the brush body;
- at least one clamping means is provided on the carrier side of each brush element; and,
- a carrier with a plurality of receptacles, wherein the brush elements are removable attached with the clamping means; wherein each clamping means is provided with at least two elastic catch hooks, which lock into one of the receptacles.

The present invention in particular relates to a brush system with at least two brush elements and a carrier, wherein each brush element comprises a brush body with a functional side having bristles on a first side of the brush body and with a carrier side on a second side of the brush body. The carrier side of each brush element has at least one clamping means, which together with a receptacle of the carrier provides for a removable attachment.

It is advantageous to use the present invention with a labeling machine which has a plurality of brush elements removably attached to carriers, which form brush systems.

The brush system of the present invention comprises at least two brush elements and a carrier with a plurality of receptacles for the brush elements. A plurality of brush elements of as far as possible like type can be mounted on and dismounted from the carrier according to need, so that the configuration of the brush system is variable and modular. Each brush element comprises a brush body with at least two sides or surfaces.

The first side of the brush body of a brush element is the functional side, carrying bristles.

The second side of the brush body of a brush element is opposite the first side and is the carrier side, cooperating with the carrier. To the carrier side of each brush element at least one clamping means is attached, which together with one of the receptacles of the carrier provides for a removable attachment. According to the present invention each clamping means has at least two elastic catch hooks, which lock into one of the receptacles. Preferably each catch hook has a projection and each receptacle an opening, so that a particular projection of a particular clamping means engages behind the respective opening. Due to the elastic catch hooks the brush elements can be inserted into or removed from the receptacles of the carrier easily, quickly, and without using tools. Furthermore the brush elements are secured firmly to the carrier by the projections of the catch hooks which engage behind the carrier.

A further advantage, as is known, is, if the abutting edge sections of any two neighboring brush elements are in form-fitting contact, so that the brush system provides a uniform and homogeneous bristle surface. Here, also as known, a form-fit by interlocking corresponding profiles of the respective facing edge sections of the brush elements is especially advantageous to counteract the high stresses to which the brush elements are subjected by possible jarring when brushing at high speed. Possible edge profiles include toothing in zig-zag, trapezoid or wave form. It is obvious for an expert that the form of the profiles does not limit the scope of the invention.

Due to reasons of materials and of cost-efficiency it is an advantage to manufacture the clamping means of the present invention together with the brush body of the brush element as one piece, for example from thermoplastic material.

The labeling machine uses a plurality of brush elements according to the present invention. As far as possible the type of the brush elements is identical and removably attached to carriers, as described above. The labeling machine for example has carriers of different shapes, which are appropriate to brush labels made of paper, plastic, or a composite material to the body or neck of bottles and/or protective labels made of tin foil, plastic, or a composite material to the top of the bottles. The carriers can be shaped differently, according to the role and the form of the elements to be brushed on, for example flat and plane, arched, or cylindrical.

BRIEF DESCRIPTION OF THE DRAWINGS

Below embodiments of the invention illustrate the invention and its advantages with the help of the attached figures. In the figures the size ratios of particular elements with respect to each other do not always correspond to the actual size ratios, as some forms are shown in a simplified manner and other forms have been enlarged with respect to other elements for better illustration.

DETAILED DESCRIPTION OF THE INVENTION

Figure 1:
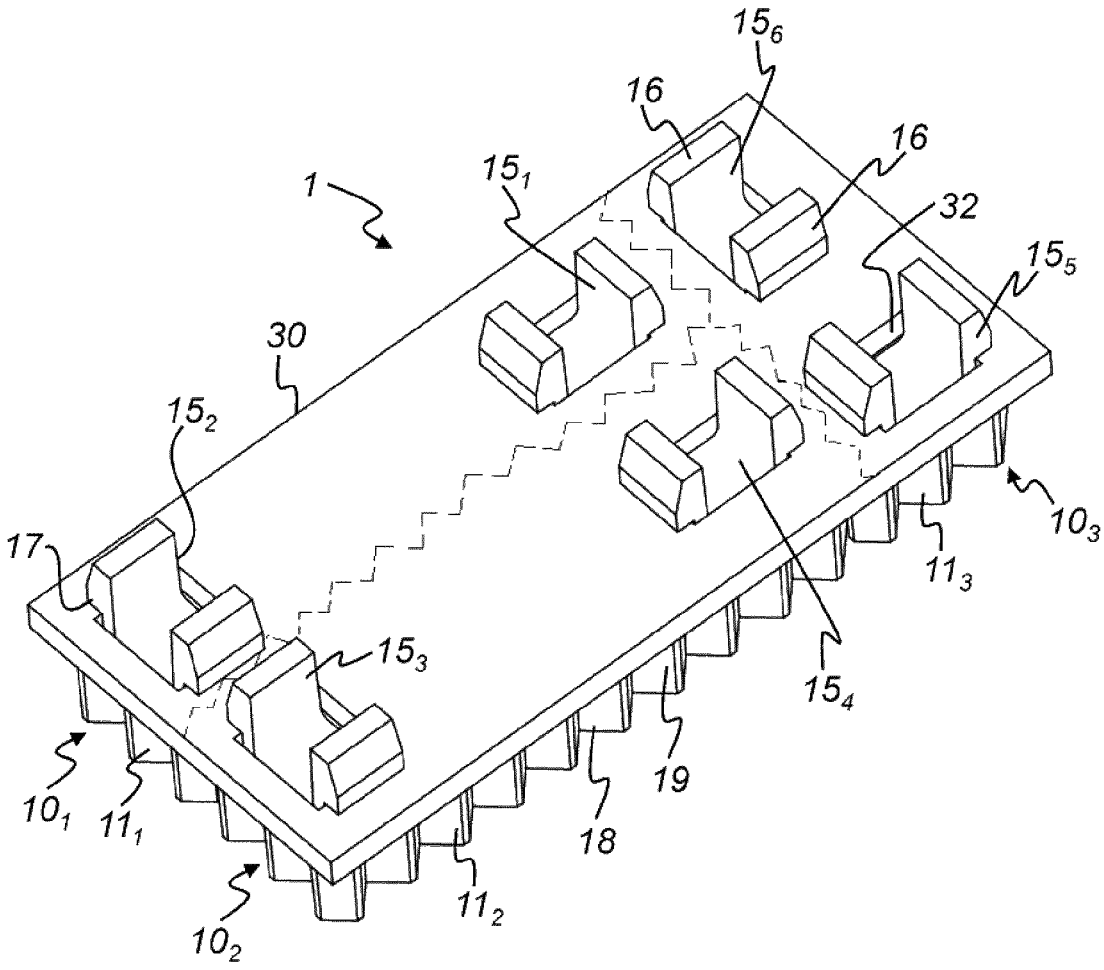
FIG. 1 shows a perspective view of an embodiment of the brush system, wherein several brush elements are mounted on a carrier.

Identical reference numerals are used for like elements of the invention or elements that function in a like manner. For the sake of clarity in each figure only those reference numerals are shown which are necessary for the description of the respective figure. The embodiments shown are only examples of how the apparatus or method of the present invention can be implemented, and do not limit the invention.

FIG. 1 shows a perspective view of an embodiment of the brush system 1, wherein several brush elements 10 are attached to a carrier 30. In this representation the carrier 30 is shown, which in this embodiment is shaped as a rectangular, plane plate. Three brush elements $\mathbf{10}_1$, $\mathbf{10}_2$, and $\mathbf{10}_3$ are removably attached to the carrier 30, which interlock form-fittingly (see FIG. 2), indicated by the dashed zig-zag lines. The carrier 30 is a single piece, and the zig-zag lines only indicate the placement of the brush elements $\mathbf{10}_1$, $\mathbf{10}_2$, and $\mathbf{10}_3$ on the carrier.

The brush elements $\mathbf{10}_1$ and $\mathbf{10}_2$ have the same shape and size, in contrast to the brush element $\mathbf{10}_3$. The brush element $\mathbf{10}_3$ is placed on the carrier 30 such that one of its long sides abuts a short side of both brush element $\mathbf{10}_1$ and $\mathbf{10}_2$, and therefore transversely to the brush elements $\mathbf{10}_1$ and $\mathbf{10}_2$, which, as is known, provides for additional stabilization of the brush elements $\mathbf{10}_1$, $\mathbf{10}_2$, and $\mathbf{10}_3$ on the carrier 30. It is evident for a person skilled in the art, however, that modifications or changes of the dimensions of the brush elements $\mathbf{10}_1$, $\mathbf{10}_2$, and $\mathbf{10}_3$ or different placement techniques can be used, without departing from the scope of the subsequent claims.

In the embodiment shown, the carrier 30 exhibits six receptacles 32 or openings of rectangular form, and fitting in both form and size the six clamping means $\mathbf{15}_1$, $\mathbf{15}_2$, . . . , $\mathbf{15}_6$ inserted therein. The clamping means $\mathbf{15}_1$ and $\mathbf{15}_2$ are located on the brush body $\mathbf{11}_1$, the clamping means $\mathbf{15}_3$ and $\mathbf{15}_4$ are located on the brush body $\mathbf{11}_2$, and the clamping means $\mathbf{15}_5$ and $\mathbf{15}_6$ are located on the brush body $\mathbf{11}_3$. In the embodiment shown the two clamping means 15 of a brush element 10 are oriented transversely to each other, again for reasons of stability.

Each of the clamping means $\mathbf{15}_1$, $\mathbf{15}_2$, . . . , $\mathbf{15}_6$ exhibits two catch hooks 16, each with a projection 17, which engages behind the carrier 30. As the catch hooks 16 are made from an elastic material, they can be pressed together and in this state can pass with the projections 17 through the receptacles 32. In this way the respective brush element 10 can be removed from the carrier 30 as well. If, as shown here, there are at most two clamping means 15 provided on each brush element 10, a user can easily remove the brush elements 10 from the carrier 30 manually. In the embodiment shown the brush bodies $\mathbf{11}_1$, $\mathbf{11}_2$, and $\mathbf{11}_3$ exhibit zig-zag profiles 19 on their edge sections 18.

Figure 2:
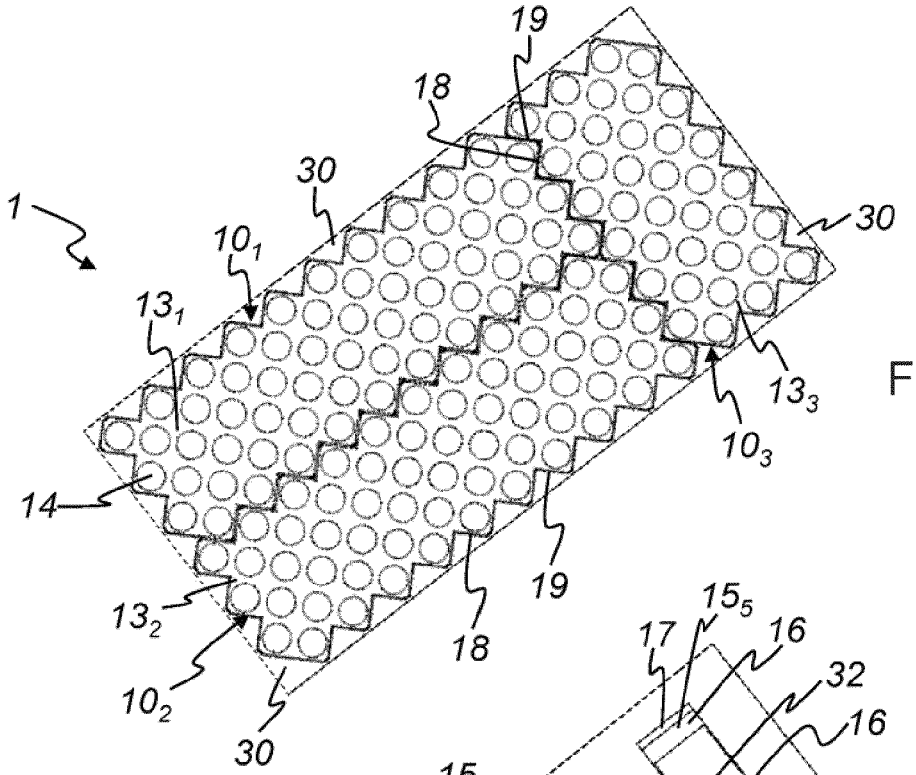
FIG. 2 shows a top view of the functional sides of the brush system according to FIG. 1.

FIG. 2 shows a top view of the functional sides 13 of the three brush elements $\mathbf{10}_1$, $\mathbf{10}_2$, and $\mathbf{10}_3$ of the brush system 1 according to FIG. 1. At the edge of the brush system 1 the surface of the carrier 30 facing the brush elements $\mathbf{10}_1$, $\mathbf{10}_2$, and $\mathbf{10}_3$ is visible. The brush elements $\mathbf{10}_1$, $\mathbf{10}_2$, and $\mathbf{10}_3$ interlock form-fittingly as described in FIG. 1 and provide a uniform and homogeneous brush surface consisting of the plurality of bristles 14, which are inserted on the functional sides 13.

The bristles 14 usually are already inserted during manufacture of the brush elements 10, which are preferably manufactured by injection molding.

Figure 3:
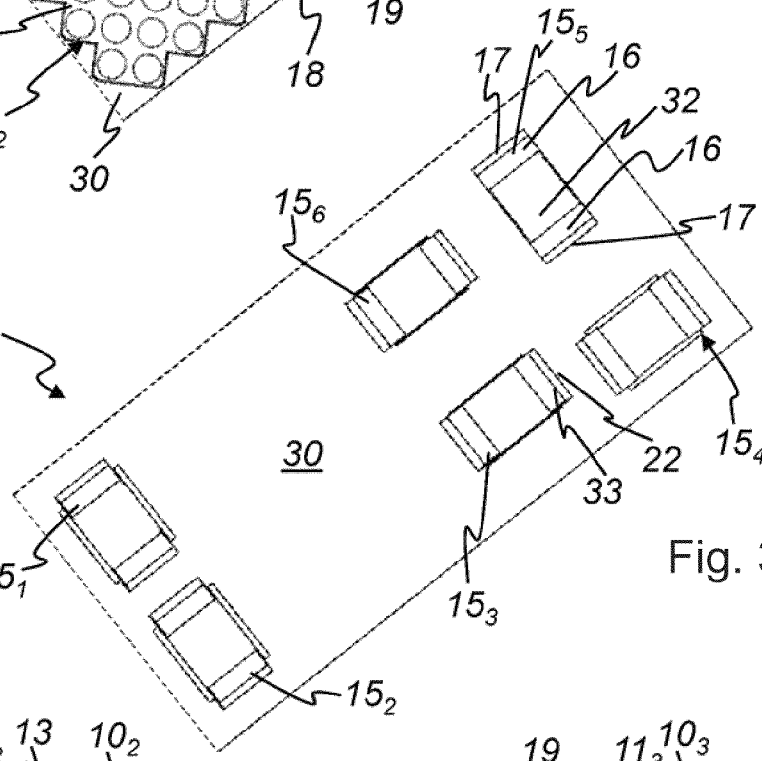
FIG. 3 shows a top view of the carrier of the brush system of FIG. 1.

FIG. 3 shows a top view of the side of the carrier 30 opposite the carrier sides 12 (not shown) of the brush elements $\mathbf{10}_1$, $\mathbf{10}_2$, and $\mathbf{10}_3$, of the brush system 1 of FIG. 1. The brush elements $\mathbf{10}_1$, $\mathbf{10}_2$, and $\mathbf{10}_3$ are attached to the carrier 30; however, in top view only the ends of the projections 17 of the catch hooks 16 of the clamping means $\mathbf{15}_1$, $\mathbf{15}_2$, . . . , $\mathbf{15}_6$ passed through the carrier 30 are visible.

The outer edges 22 of the projections 17 extend beyond the edges 33 of the receptacles 32 with respect to the center of the respective clamping means $15_1$, $15_2$, . . . , $15_6$, and thus the projections 17 engage behind the carrier 30.

Figure 4:
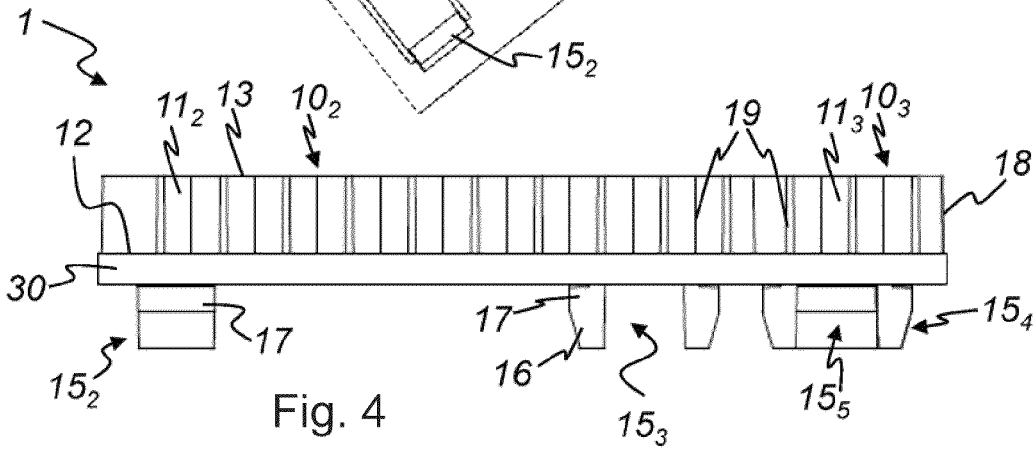
FIG. 4 shows a side view of the brush system according to FIG. 1.

FIG. 4 shows a side view of the brush system 1 according to FIG. 1. In the side view only the brush elements $10_2$ and $10_3$ are visible, whose outlines, however, are not visible in side view due to the zig-zag profiles 19 of the edge sections 18.

Facing away from the carrier 30 the two visible brush bodies $11_2$ and $11_3$ of the brush elements $10_2$ and $10_3$ each exhibit a functional side 13; bristles, however, are not shown here. The carrier sides 12 of the respective brush bodies $11_2$ and $11_3$ are attached to the carrier 30, if the catch hooks 16 of the clamping means $15_1$, . . . , $15_6$ are locked into the carrier. The chosen view shows the clamping means $15_2$, $15_3$, and $15_4$ in the foreground, and the clamping means $15_5$ behind the clamping means $15_4$.

Figure 5:
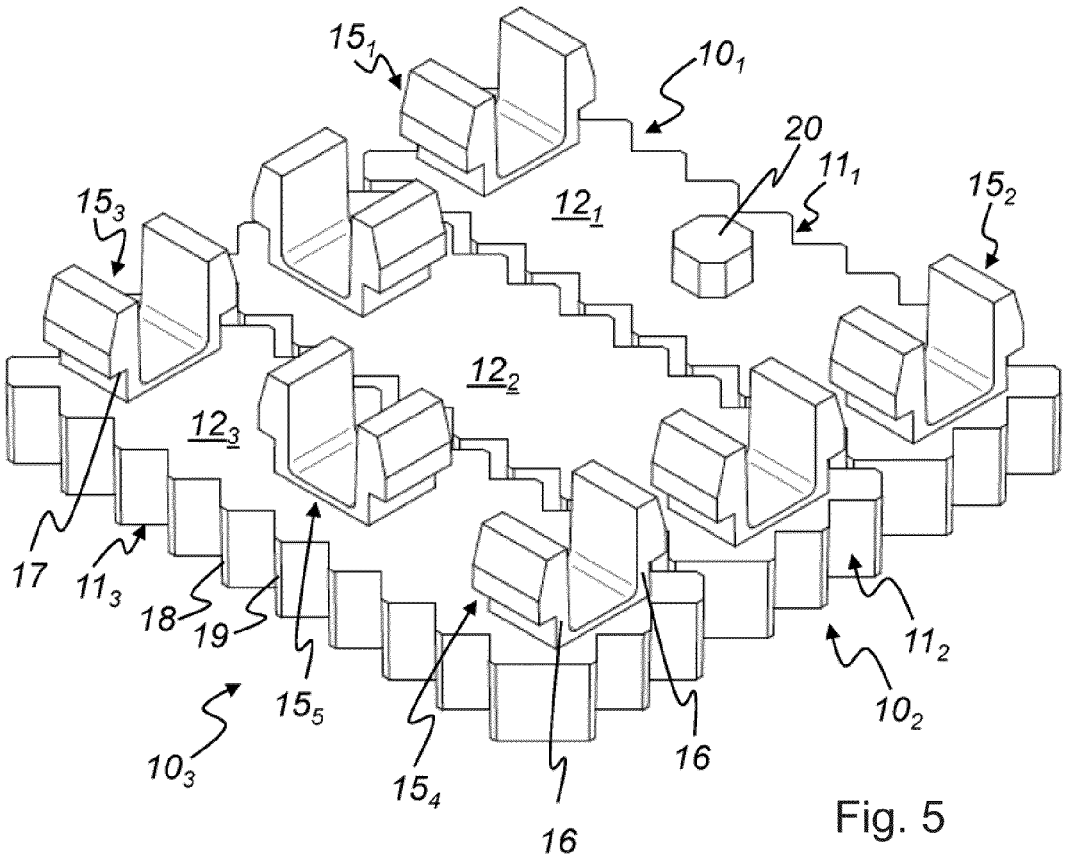
FIG. 5 shows a perspective view of three different embodiments of brush elements, each exhibiting different clamping means.

FIG. 5 shows a perspective view of three different embodiments of brush elements $10_1$, $10_2$, and $10_3$, each exhibiting different clamping means 15. The brush element $10_1$ additionally exhibits a nub 20 between the clamping means $15_1$ and $15_2$. The nub 20 facilitates mounting the brush element $10_1$ on the carrier 30, as it functions as a guide. Another brush element $10_3$, in addition to the two outer clamping means $15_3$ and $15_4$, can exhibit a further clamping means $15_5$, which provides for an additional fixture and further stabilization of the brush element $10_3$ on the carrier 30. This is particularly expedient in the case of long brush elements 10.

Figure 6:
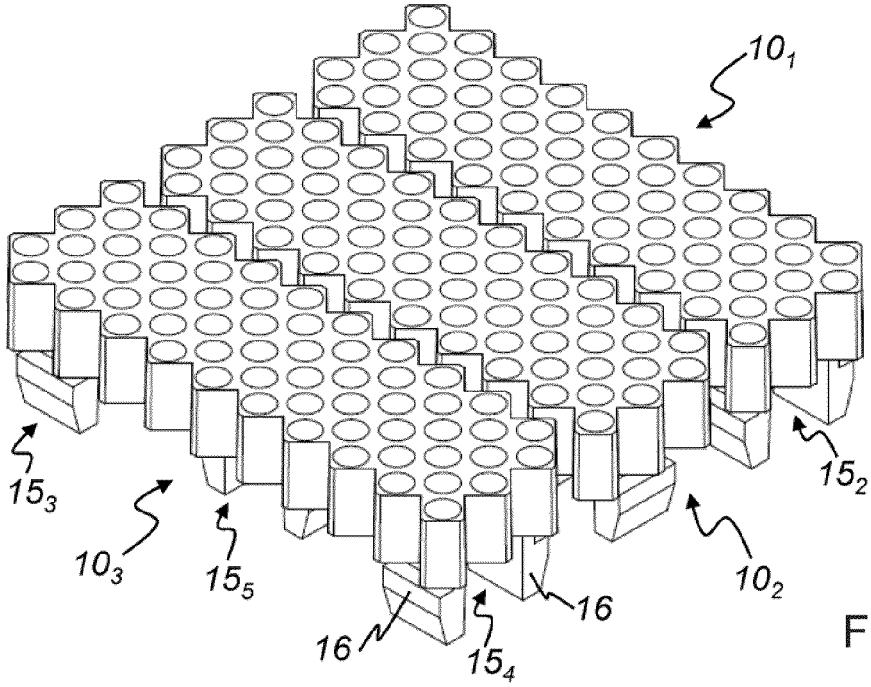
FIG. 6 shows a perspective view from below of the three different embodiments of brush elements according to FIG. 5.

FIG. 6 shows a perspective view from below of the three different embodiments of the brush elements 10 according to FIG. 5. All elements have already been described in FIG. 5.

Figure 7:
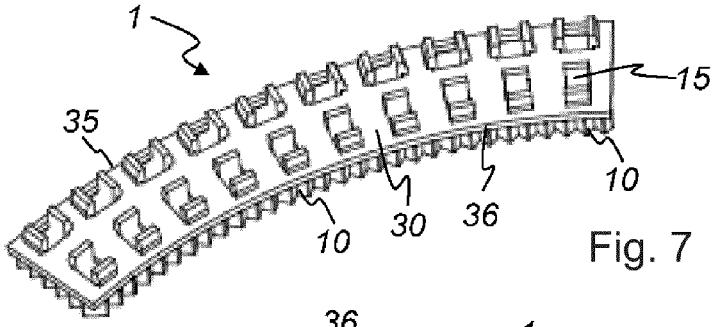
FIG. 7 shows a perspective view of a further embodiment of the brush system with an arched carrier and a plane brush surface consisting of bristles.

FIG. 7 shows a perspective view of a further embodiment of the brush system 1 with an arched carrier 30 and a plane brush surface exhibiting bristles 14 (not shown). Below a plane surface of the carrier 30 a plurality of brush elements 10 is removable attached, whose outlines again are not visible in the drawing due to the zig-zag profile 19 of the edge sections 18.

The rectangular clamping means 15 of the brush elements 10 on the longer convex side 35 of the arch of the carrier 30 are arranged in a row with their longer sides oriented along the longer side 35 of the arch. On the other hand the clamping means 15 on the shorter concave side 36 of the arch of the carrier 30 are arranged in a row with their shorter sides oriented along the shorter side 36 of the arch. By this arrangement the clamping means 15 form pairs of opposing clamping means 15, with one member of each pair on the longer side 35 of the arch and the other member of the respective pair on the shorter side 36 of the arch, wherein the members of each pair are oriented transversely to each other, which enhances the stable attachment to the carrier 30, as described above.

Figure 8:
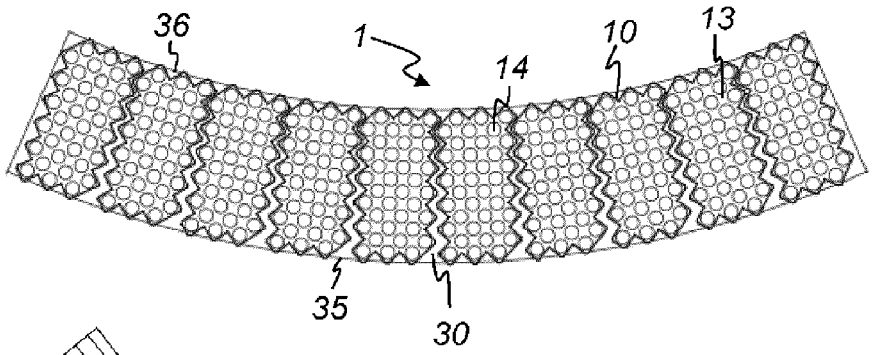
FIG. 8 shows a top view of the functional sides of the brush elements of the brush system according to FIG. 7.

FIG. 8 shows a top view of the functional sides 13 of the brush elements 10 of the brush system 1 according to FIG. 7. At the edge of the brush system 1 the surface of the carrier 30 facing the brush elements 10 is visible. In this embodiment, due to the arrangement in an arch, the rectangular brush elements 10 do not make completely form-fitting contact.

Figure 9:
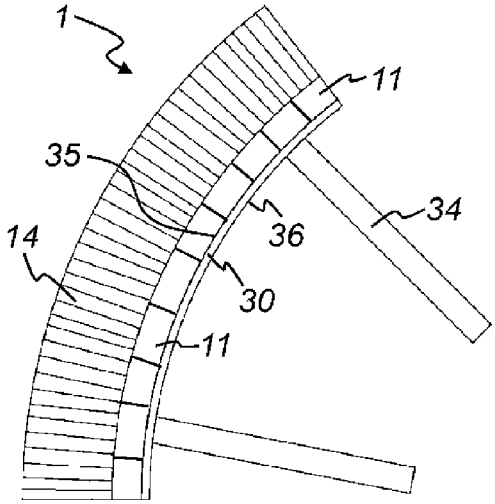
FIG. 9 shows a side view of another embodiment of the brush system with an arched carrier and a convex brush surface consisting of bristles, which is formed by the brush elements attached to the carrier; and, FIG. 10 shows a side view of a further embodiment of the brush system with an arched carrier and a concave brush surface consisting of bristles, which is formed by the brush elements attached to the carrier.

FIG. 9 shows a side view of a further embodiment of the brush system 1 with an arched carrier 30, wherein the attached brush elements 10 form a convex brush surface with bristles 14. The curvature of the convex brush surface is adjusted and set with bolt 34 in the labeling machine when mounting the carrier 30.

Figure 10:
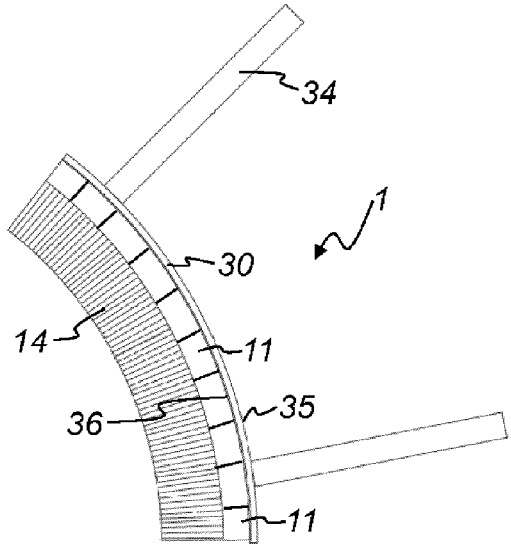

FIG. 10 shows a side view of a further embodiment of the brush system 1 with an arched carrier 30, wherein the attached brush elements 10 form a concave brush surface with bristles 14. The curvature of the concave brush surface is adjusted and set with bolt 34 in the labeling machine when mounting the carrier 30.

The invention has been described with respect to a preferred embodiment. However, it is obvious for a skilled person that modifications or changes can be made without leaving the scope of the following claims. In particular the carrier 30, catch hooks 16, projections 17 and/or the receptacles 32 can be shaped differently, without leaving the scope of the claims below. Essential for all embodiments of the invention is in particular the elasticity of the catch hooks.

What is claimed is:

1. A brush system for a labeling machine comprising:

at least two brush elements, wherein each brush element comprises a brush body with a functional side having a plurality of bristles on a first side of the brush body and with a carrier side on a second side of the brush body, each brush element having at least one edge section;

at least one clamping means is provided on the carrier side of each brush element; and, a carrier with a plurality of receptacles, wherein the brush elements are removably attached with the clamping means, wherein each clamping means is provided with at least two elastic catch hooks, which lock into one of the receptacles, wherein the functional side that receives the plurality of bristles is laminar, wherein the brush elements and the carrier are separable from one another, wherein two of the at least two adjacent brush elements form-fittingly interlock at adjacent edge sections, and wherein the form-fit is created by interlocking corresponding profiles of the respective adjacent edge sections.

2. The brush system of claim 1, wherein each catch hook has a projection and each receptacle has at least one opening, so that a particular projection of a particular clamping means engages behind the respective opening.

3. The brush system of claim 1, wherein each brush element has edge sections wherein abutting edge sections of any two neighboring brush elements exhibit a form-fit with each other.

4. The brush system of claim 3, wherein the form-fit is achieved by interlocking corresponding profiles of the respective facing edge sections of the brush elements.

5. The brush system of claim 1, wherein the clamping means are manufactured together with the respective brush body of brush element as one piece.

6. The brush system of claim 5, wherein the brush body together with the clamping means is made of thermoplastic material.

* * * * *